US005250233A

United States Patent [19]

Swanson

[11] Patent Number: 5,250,233

[45] Date of Patent: Oct. 5, 1993

[54] CARBURETOR WITH ACCELERATOR AND IDLE CIRCUIT SHUT-OFF

[75] Inventor: Mark S. Swanson, Cass City, Mich.

[73] Assignee: Walbro Corporation, Cass City, Mich.

[21] Appl. No.: 980,462

[22] Filed: Nov. 23, 1992

[51] Int. Cl.[5] ..... F02M 3/02

[52] U.S. Cl. ..... 261/34.2; 261/35; 261/51; 261/DIG. 68

[58] Field of Search ..... 261/34.2, 51, DIG. 68, 261/35

[56] References Cited

U.S. PATENT DOCUMENTS

| | | | |
|---|---|---|---|
| 2,261,794 | 11/1941 | Carlson et al. | 261/50.1 |
| 2,649,290 | 8/1953 | Griffon | 261/34.2 |
| 2,679,835 | 6/1954 | Thomer | 261/DIG. 68 |
| 2,824,725 | 2/1958 | Dietrich | 261/34.2 |
| 3,003,754 | 10/1961 | Phillips | 261/DIG. 68 |
| 3,743,254 | 7/1973 | Tuckey | 261/34.2 |
| 4,861,522 | 8/1989 | Gerhardy et al. | 261/51 |

*Primary Examiner*—Tim Miles

*Attorney, Agent, or Firm*—Barnes, Kisselle, Raisch, Choate, Whittemore & Hulbert

[57] ABSTRACT

A diaphragm carburetor with both the main metering nozzle and an idle circuit supplied with liquid fuel from the same metering chamber and an accelerator and shut-off assembly in the idle circuit. The assembly has a valve which is open to supply fuel to the idle circuit when the throttle is in a closed idle position and closes off the supply of fuel from the metering chamber as the throttle is moved to its wide open position. Opening of the throttle also actuates a piston to supply additional fuel for accelerating an engine.

7 Claims, 2 Drawing Sheets

CARBURETOR WITH ACCELERATOR AND IDLE CIRCUIT SHUT-OFF

FIELD OF THE INVENTION

This invention relates to engine fuel systems, and more particularly to gasoline carburetors for internal combustion engines.

BACKGROUND OF THE INVENTION

Previously known carburetors for small engines have a flexible diaphragm disposed in a fuel chamber which supplies fuel to both main and idling nozzles or orifices opening into a venturi through which combustion air flows when the engine is operating. Typically, the other side of the diaphragm is subjected to atmospheric pressure and in operation controls a fuel inlet valve disposed between the fuel chamber and a supply of fuel to regulate and maintain substantially constant the pressure of fuel in the fuel chamber.

In operation, when a throttle valve in the throttle bore is rapidly moved from an idle to a wide open position, the engine initially momentarily stumbles because the fuel mixture is too lean. When the engine is operating at wide open throttle, fuel bleeds or is removed from the idle circuit of the carburetor. Consequently, when the engine goes from full throttle to idle, it frequently stumbles and sometimes stalls because the idle circuit supplies insufficient fuel to the engine. Furthermore, when operating at part throttle, the carburetor supplies a fuel mixture which is richer than the ideal mixture for operation of the engine. There are also substantial variations in the level or ratio of carbon monoxide in the exhaust under varying engine load conditions.

SUMMARY OF THE INVENTION

A carburetor with idle and main metering jets supplied with fuel from a common metering chamber in which a combined accelerator pump and shut-off device controls the flow of fuel to the idle jet. Preferably, the accelerator and shut-off device is actuated by movement of the throttle from its idle position to initially supply a relatively small quantity of additional fuel for accelerating the engine and to shut-off the idle circuit under wide open throttle operating conditions. Shutting off the idle circuit prevents bleed back of fuel so that when the throttle returns to its idle position and the shut-off device opens, fuel is immediately supplied to the idle jet for operation of the engine under idle conditions. Preferably, the shut-off device has a combined piston and valve assembly yieldably biased to its retracted and open position when the throttle is in its idle position. Preferably, the piston and valve are operably connected with the throttle shaft so that when it moves the throttle valve to its wide open position it also moves the piston to its advanced position to deliver a small quantity of additional fuel to accelerate the engine and closes the valve to prevent fuel from bleeding from the idle circuit during wide open throttle operating conditions.

Objects, features and advantages of this invention are to provide a carburetor with fuel supplied to main and idle jets from a common metering chamber which facilitates acceleration of an engine from its idle condition, substantially eliminates momentary hesitation and stumbling of the engine as it rapidly accelerates from its idle condition, eliminates stumbing and stalling of the engine during its rapid transition from wide open throttle to idle operating conditions, decreases carbon monoxide and other engine exhaust emissions, provides a more desirable fuel to air ratio and mixture during engine part throttle operating conditions, is of relatively simple design and economical manufacture and assembly, and has a long useful life in service.

BRIEF DESCRIPTION OF THE DRAWINGS

These and other objects, features and advantages of this invention will be apparent from the following detailed description of the best mode, appended claims and accompanying drawings in which:

DETAILED DESCRIPTION OF THE PREFERRED EMBODIMENT

Figure 1:
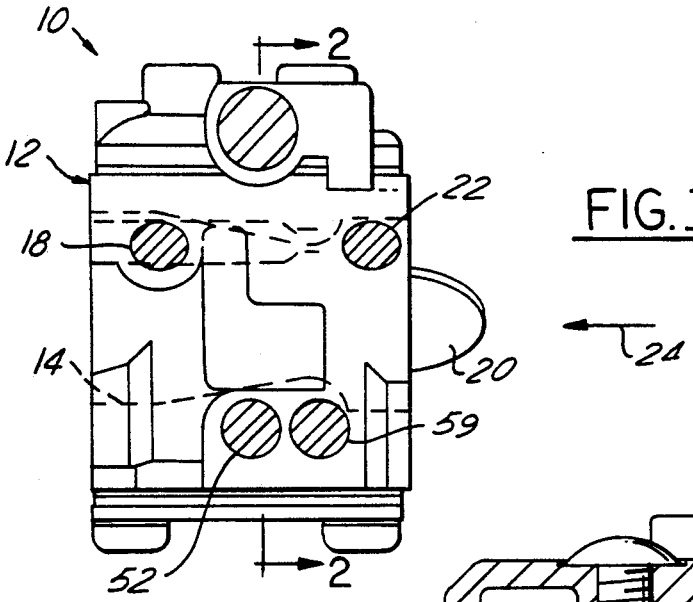
FIG. 1 is a side view of a carburetor embodying this invention.
Figure 2:
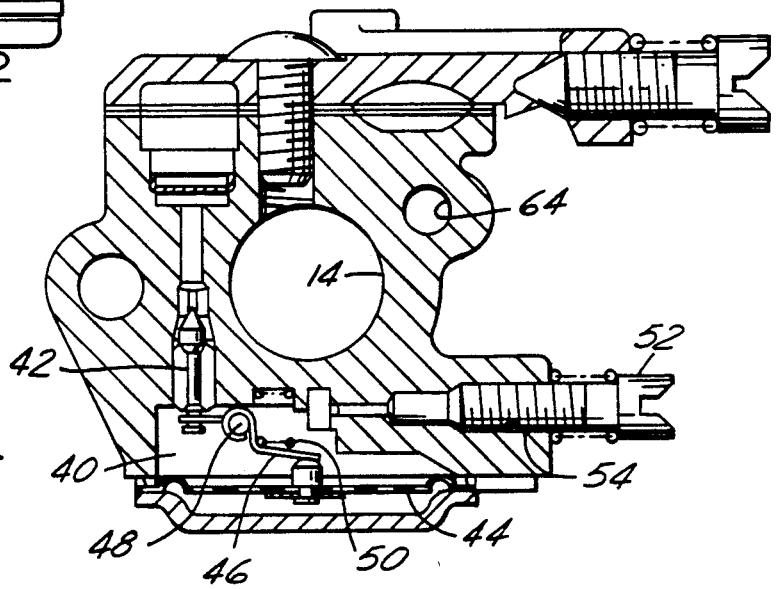
FIG. 2 is a sectional view taken generally on line 2—2 of FIG. 1.
Figure 3:
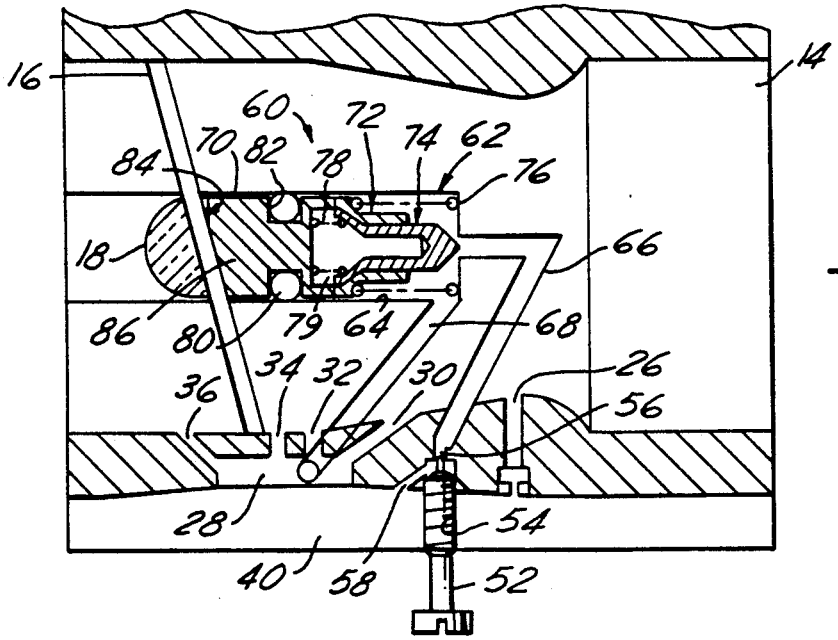
FIG. 3 is an enlarged and somewhat schematic sectional view of several component parts of the carburetor of FIG. 1.

FIGS. 1 and 2 illustrate a diaphragm carburetor 10 embodying this invention with a body 12 having a through venturi passage 14 in which a throttle valve plate 16 (FIG. 3) mounted on a throttle shaft 18 is disposed. The throttle valve is movable from its idle position, as shown in FIG. 3 to a wide open throtle position by rotating the shaft 18 so that the plate 16 is disposed substantially parallel to the direction of flow of air through the venturi. Preferably, a choke valve plate 20 mounted on a choke shaft 22 is also disposed in the venturi passage upstream of the throttle valve. In use, the carburetor is mounted on an intake manifold of an engine so atmospheric air will flow through the venturi passage 14 in the direction of the arrow 24.

Fuel is supplied to both a main metering nozzle 26 and an idle fuel pocket 28 and ports 30, 32, 34 and 36 from a metering chamber 40 in the body. In operation, fuel in the metering chamber is maintained at a substantially constant subatmospheric pressure by a metering valve 42 actuated by a diaphragm 44 with one face communicating with the metering chamber 40 and the other with the atmosphere. The valve 42 is operably connected to the diaphragm by a lever arm 46 pivoted on a pin 48 and biased by a spring 50. The quantity of fuel normally supplied to the idle pocket 28 and ports 30–36 from the metering chamber can be varied and adjusted within predetermined limits by a needle valve 52 received in a threaded passage 54 with a seat 56 therein and communicating with the metering chamber through a port 58. Similarly, the quantity of fuel supplied to the main nozzle 26 can be varied and adjusted within predetermined limits by a needle valve 59 threaded in a passage with a complementary seat (not shown) and in communication with the metering chamber and the main jet or nozzle 26. Since the high speed jet, idle well, idle ports, needle valves, metering chamber and diaphragm may be all of conventional construction well-known to those skilled in the art, they will not be described in further detail herein.

Figure 4:
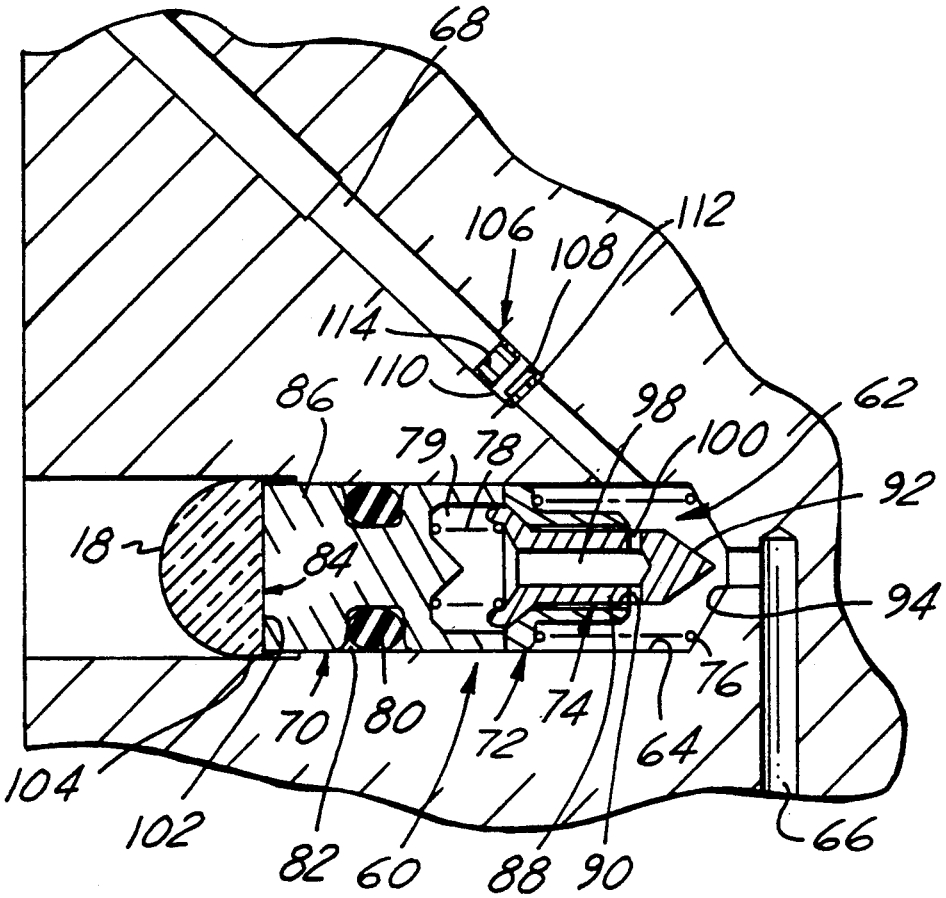
FIG. 4 is an enlarged sectional view of the pump and shut-off device of the carburetor of FIG. 1.

In accordance with this invention, an accelerator pump and shut-off device 60 controls the quantity of fuel supplied to the idling well and ports under various operating conditions. The device has a pump chamber 62 formed by a blind bore 64 in the body which receives fuel from the metering chamber 40 through a passage 66 which communicates with the idle adjustment valve 52. Fuel is supplied to the idle well 28 and ports 30-36 through a passage 68 which communicates with the pump chamber 62 and the idle well 28. As shown in FIGS. 3 and 4, the device has a piston 70 slidably received in the bore 64 and bearing on a guide 72 in which a valve 74 is slidably received. The piston and guide are yieldably biased to their retracted positions by a compression spring 76 received in the chamber and the valve 74 is yieldably biased into engagement with the guide by a compression spring 78 received in a pocket 79 in the piston. Preferably, the preload of the spring 78 is less than the preload of the spring 76. A seal is provided between the bore 64 and the piston by an 0-ring 80 received in a groove 82 in the piston. The piston is advanced by a cam 84 in the throttle shaft which bears on a head 86 of the piston.

The valve 74 has a stem 88 slidably received in a central bore 90 through the annular guide 72 and terminating in a conical tip 92 which when the valve is advanced bears on and seals with a complementary seat 94 in the bore. To insure fuel does not inhibit relative movement of the valve 74 and the piston 70, its pocket 79 communicates with the chamber 62 through passages 98 and 100 in the stem. Preferably, to accommodate manufacturing tolerances and to avoid any damage to the valve seat 94, the piston 70 does not bottom out on the valve when it is fully advanced by rotation of the cam 84 by the throttle shaft 18. Similarily, to prevent damage to the cam 84 and piston head 86, preferably the guide 72 does not bottom out in the bore 64 when the piston 70 is fully advanced. Preferably, the cam 84 has a generally flat face 102 which bears on the piston when the throttle plate 16 is in the idle position and an edge 104 which bears on the piston as it is moved by the cam. Preferably, the edge 102 has a relatively sharp radius where it blends into the cylindrical peripheral surface of the shaft.

Reverse flow of fuel through the passage 68 is prevented by a check valve assembly 106 press fit therein and having a disc 108 entrapped in a retainer 110 and receivable on a seat 112 to seal and check or prevent reverse flow of the fuel. When fuel flows through the passage 68 to the idle well 28, the fuel displaces the disc 108 from its seat, flows around the periphery of the disc and urges the disc into engagement with three circumferentially spaced stop ribs 114 in the cage between which the fuel flows.

In use, the carburetor is attached to the intake manifold of an engine which is typically a two-stroke or a fourstroke internal combustion engine with an output of ¼ to 50 horsepower. In operation, when the engine is idling, the piston 70 is retracted and the valve 74 is open so that fuel is supplied to the idle well 28 and ports 30-36 through the passages 66 and 68 and the check valve 106. While idling, the throttle valve plate 16 and shaft 18 are in the closed position, as shown in FIG. 3 of the drawings. While idling, air flows through the ports 30-34 upstream of the throttle plate, entrains fuel in the idle pocket 28 and is discharged through the idle port 36 downstream of the plate and into the intake manifold of the engine.

As the shaft 18 is rotated (counterclockwise in FIGS. 1 and 3) to move the throttle plate 16 from the idle to the wide open throttle position, the cam 84 advanced the piston 70 and valve 74 so that the valve tip 92 bears on the seat 94 and shuts off the flow of fuel from the metering chamber 62. Further advancement of the piston by rotation of the throttle shaft also pumps a quantity of fuel from the chamber 62 through the idle well 28 and ports 30-36 and into the intake manifold which provides fuel for initially accelerating the engine. As the engine accelerates, the flow of air through the venturi increases and thus fuel is supplied through the high speed or main metering nozzle 26. During wide open throttle operation, the valve 74 remains closed so that no additional fuel is supplied to the idle well. During wide open throttle operation of the engine, the check valve 104 prevents any back-flow of fuel and any entrained air from the idle well toward the chamber 62.

It has been discovered that with some engines and carburetors, substantially immediately upon initial opening or movement of the throttle valve plate 16 away from its idle position, there is a momentary reverse flow or back-flow of fuel from the idle pocket which adversely affects engine performance. This back flow is prevented by the check valve 106. For these engines and carburetors, it is highly preferable to include this check valve 106 because this momentary reverse flow would otherwise occur before the shut off valve 74 is closesd by rotation of the throttle shaft.

When the engine rapidly decelerates from wide open throttle to idle conditions, rotation of the throttle shaft and cam 84 to their idle positions permits the piston 70 to be rapidly retracted by the bias of the compression spring 76 which both unseats and opens the valve 74 and produces a pumping action tending to draw fuel from the metering chamber 40 to fill the pump chamber 62 and supply fuel to the idle pocket 28 and idle ports 30-36 for operation of the engine under idling conditions. As the piston 70 is retracted, the check valve 104 insures that there is no reverse flow of any fuel and entrained air from the idle well into the pump chamber 62.

Due to the "lost motion" between the piston 70 and valve 74, the cam 84, piston and valve assembly is designed and constructed so that when the throttle is only partially open the valve 74 bears on the seat and shuts off the supply of fuel to the idle well 28 and ports 30-36 thereby eliminating the influence of the idle circuit on the fuel ratio or mixture under engine partial load conditions so that the fuel mixture is determined solely by the main nozzle 26. This provides a better fuel to air mixture for operating the engine under partial load conditions and reduces carbon monoxide and other engine exhaust emissions. The extent to which the throttle is opened when the valve 74 first closes can be varied by changing the extent and rate of the cam displacement of the piston 70 relative to the extent of the lost motion between the piston and the valve 74.

What is claimed is:

1. In a carburetor having a mixing passage, a throttle valve disposed in said mixing passage and movable between a closed idle position and an wide open throttle position, a liquid fuel metering chamber, a main fuel nozzle communicating with said metering chamber and said mixing passage upstream of said throttle valve when in said idle position, and at least one idle fuel port communicating with said mixing passage downstream of said throttle valve when in its closed idle position, an accelerator and idle fuel shut-off assembly comprising, a piston chamber, an inlet to said piston chamber communicating with said fuel metering chamber, an outlet from said piston chamber communicating with said at least one idle port, a piston slidably received in said piston chamber and movable between extended and retracted positions, a valve member received in said piston chamber and operably associated with said piston for movement thereby to open and closed positions to control admission of fuel from said metering chamber into said piston chamber, and an actuator operably connecting said throttle valve with said piston so that as said throttle valve moves from its closed idle position to its wide open throttle position, said piston and valve are initially advanced to close said valve and thereafter said piston is further advanced to supply fuel from said piston chamber to said at least one idle port for accelerating an engine, and when said throttle is moved to its closed idle position, said piston and valve member are retracted and said valve member is moved to its open position to supply fuel from said metering chamber through said piston chamber and to said at least one idle port for idling the engine.

2. The carburetor of claim 1 which also comprises a spring received in said piston chamber and yieldably biasing said piston to its retracted position.

3. The carburetor of claim 1 which also comprises a valve guide associated with said piston for movement in unison therewith, said valve member is slidably received in said valve guide for movement to advanced and retracted positions relative to said guide, a first spring received in said piston chamber and yieldably biasing said piston toward its retracted position, and a second spring carried by said piston and yieldably biasing said valve member toward its advanced position relative to said valve guide.

4. The carburetor of claim 3 which also comprises, a throttle shaft connected to said throttle valve for closing and opening said throttle valve by rotation of said shaft, and said actuator comprises a cam carried by said shaft and operably associated with said piston for moving said piston from its retracted position to its advanced position in response to rotation of said shaft to move said throttle valve from its closed idle position to its wide open throttle position.

5. The carburetor of claim 4 which also comprises a flexible diaphragm having a face communicating with said fuel metering chamber and said diaphragm is constructed and arranged to regulate the pressure of liquid fuel in said metering chamber.

6. The carburetor of claim 1 wherein said actuator comprises, a spring received in said piston chamber and yieldably biasing said piston toward its retracted position, and a cam operably associated with said piston and carried by a throttle shaft connected to said throttle valve and constructed and arranged so that rotation of said shaft to move said throttle valve from its closed idle position to its wide open throttle position also moves said piston from its retracted position to its advanced position.

7. The carburetor of claim 6 which also comprises a flexible diaphragm having a face communicating with said fuel metering chamber and said diaphragm is constructed and arranged to regulate the pressure of liquid fuel in said metering chamber.

* * * * *